US008321990B2

(12) United States Patent
Lee

(10) Patent No.: US 8,321,990 B2
(45) Date of Patent: Dec. 4, 2012

(54) DETACHABLE MULTIFUNCTIONAL CLEANER

(76) Inventor: Pil Hee Lee, Chungcheongbuk-do (KR)

( * ) Notice: Subject to any disclaimer, the term of this patent is extended or adjusted under 35 U.S.C. 154(b) by 802 days.

(21) Appl. No.: 12/269,116

(22) Filed: Nov. 12, 2008

(65) Prior Publication Data

US 2009/0293216 A1 Dec. 3, 2009

(30) Foreign Application Priority Data

Jun. 3, 2008 (KR) ..... 10-2008-0052156

(51) Int. Cl.
*A46B 7/02* (2006.01)

(52) U.S. Cl. ..... 15/244.2; 15/144.1; 15/172; 15/209.1; 15/220.1

(58) Field of Classification Search ..... 15/209.1, 15/210.1, 220.1, 228, 231, 232, 144.1, 172, 15/176.1, 244.1, 244.2
See application file for complete search history.

(56) References Cited

U.S. PATENT DOCUMENTS 2,192,861 A * 3/1940 Burchell ..... 15/147.2
2,675,573 A * 4/1954 Strong ..... 15/176.4
3,339,220 A * 9/1967 Barry ..... 15/233
5,272,783 A * 12/1993 Richardson et al. ..... 15/119.2
5,551,115 A * 9/1996 Newville ..... 15/172
5,553,344 A * 9/1996 Rosenkrantz ..... 15/104.002
5,794,302 A * 8/1998 Lin ..... 15/172
5,839,147 A * 11/1998 Chia-Yi et al. ..... 15/119.2
5,862,565 A * 1/1999 Lundstedt ..... 15/220.1
6,546,584 B2 * 4/2003 Hobden ..... 15/144.1
6,687,943 B2 * 2/2004 Zorzo ..... 15/228
6,804,853 B2 * 10/2004 Wang ..... 15/172
7,155,770 B2 * 1/2007 Anderson et al. ..... 15/111
7,178,189 B1 * 2/2007 Perry et al. ..... 15/119.2
7,565,715 B2 * 7/2009 Harper et al. ..... 15/228
7,600,401 B2 * 10/2009 Rosenzweig ..... 68/5 R
7,841,039 B1 * 11/2010 Squire ..... 15/118

* cited by examiner

*Primary Examiner* — Mark Spisich
*Assistant Examiner* — Michael Jennings
(74) *Attorney, Agent, or Firm* — IPLA P.A.; James E. Bame

(57) ABSTRACT

A detachable multifunctional cleaner comprises a handle which has an insertion piece downwardly protruded from one end; a cover which has an insertion hole at one side of an upper surface for inserting the insertion piece; and a foreign substance removing means which is detachably attached to the cover, wherein the insertion piece and the insertion hole are assembled on a vertical line Z with respect to a bottom surface of the cover, and at least one position determination protrusion and at least one position determination groove are formed in the insertion piece and the insertion hole, respectively, for determining the engaging position of the handle.

5 Claims, 8 Drawing Sheets

DETACHABLE MULTIFUNCTIONAL CLEANER

CROSS REFERENCE

This application claims foreign priority under Paris Convention and 35 U.S.C. §119 to Korean Patent Application No. 10-2008-0052156, filed Jun. 3, 2008 with the Korean Intellectual Property Office.

BACKGROUND OF THE INVENTION

1. Field of the Invention

The present invention relates to a multifunctional cleaner which is capable of cleaning pollutants such as dusts from a vehicle, items, furniture or the like and polishing the same, and in particular to a detachable multifunctional cleaner in which an engaged part between a handle and a cover is reliable and stable, and it is easy to change an assembling position of a handle or a cover for a user's easier and convenient work while achieving a cleaning work, and dust and pollutant removing and polishing work.

2. Description of the Prior Art

A cleaning utensil such as a dust cleaner, oily floor cloth or the like is generally used for removing dusts or foreign substances attached on a glass of a vehicle, a glass window, items used in life, and furniture.

The above cleaning utensil includes a long handle for holding with hands, and a removing part (or oily floor cloth) is connected at one end of the handle. The above cleaning utensil occupies a lot of storing spaces since the entire length of a dust cleaner is long due to a long handle.

In order to overcome the above problems, the Korean utility model registration number 20-0347482 (registered date: Mar. 31, 2004) discloses a dust remover for vehicle. In the above dust remover for vehicle, a horizontal direction insertion part is formed in a cover plate, and a handle is inserted into the insertion part in one direction or in the opposite direction, and an engaging member is formed of an elastic member or is implemented based on a screw engaging method. However, it is disadvantageous that engaging parts are additionally needed. Since an engaging direction of the handle and the cover plate is the same as an operation direction that the handle is pushed, the engaging force is so weak. In case of the screw engaging method, loosening and tightening works make a lot of inconvenience, and it is needed to design a screw loosening function.

As another conventional art, the Korean utility model registration number 20-0415345 (registered date: Apr. 25, 2006) discloses a dust remover for vehicle. In the above dust remover for vehicle, a cover is rotatably supported at one end of a handle by using a rotary shaft, and a stopper supported by a spring with the help of a lever is selectively inserted into a plurality of engaging holes formed in a cover, and the cover can rotate at 180° for easier storage.

In the above conventional art, since a lever, a stopper, a rotary shaft or something are installed, the number of parts increases. The construction of a handle part for installing the above parts might be complicated. In addition, since a contact surface of a cover and a handle part might not be closely contacted due to the structure that the cover is rotatably supported, it might move during the cleaning of a vehicle, so it is impossible to more intensively clean the dusts.

SUMMARY OF THE INVENTION

Accordingly, it is an object of the present invention to provide a multifunctional cleaner which overcomes the problems found in the conventional art.

It is another object of the present invention to provide a multifunctional cleaner in which an engaged structure of a handle part and a cover can be easily separated or engaged, so its manufacture is cheap, and its use is easy. Even when it is rotated in all directions, a reliable and stable use can be obtained.

It is further another object of the present invention to provide a multifunctional cleaner which is able to perform a dust removing work, an oily cleaning, a polishing work and a water cleaning as an attachment is changed in one cleaner.

To achieve the above objects, there is provided a detachable multifunctional cleaner which comprises a handle which has an insertion piece downwardly protruded from one end; a cover which has an insertion hole at one side of an upper surface for inserting the insertion piece; and a foreign substance removing part which is detachably attached to the cover, wherein the insertion piece and the insertion hole are assembled on a vertical line Z with respect to a bottom surface of the cover, and at least one position determination protrusion and at least one position determination groove are formed in the insertion piece and the insertion hole, respectively, for determining the engaging position of the handle.

The insertion piece is formed in a cylindrical shape having a tapered part on an outer surface of the front end.

Two position determination protrusions being apart from the tapered part are formed on the outer surface of the insertion piece at 180° from each other.

A plurality of engaging ribs are formed in an inner surface of the insertion hole while linearly contacting with the outer surface of the insertion piece.

A concave part is formed on an upper surface of the cover, so hands can be easily inserted between the handle and the cover.

The foreign substance removing part is one among an oily cleaning cloth, a sponge cleaning cloth, and a hairy cleaning cloth which are detachably attached to a Velcro fastener attached to a bottom surface of the cover.

According to the detachable multifunctional cleaner of the present invention, a separating and assembling structure of a handle part and a cover is improved, by which a manufacturing cost is low, and its use is easy. Even when it is engaged in all directions, a reliable and safer cleaning work can be obtained with more intensive cleaning force.

In addition, as an oily cleaning cloth, a sponge cleaning cloth and a hairy cleaning cloth can be used, all of a dust removing work, a water cleaning work, an oily cleaning work and a polishing work can be all used.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

Figure 1:
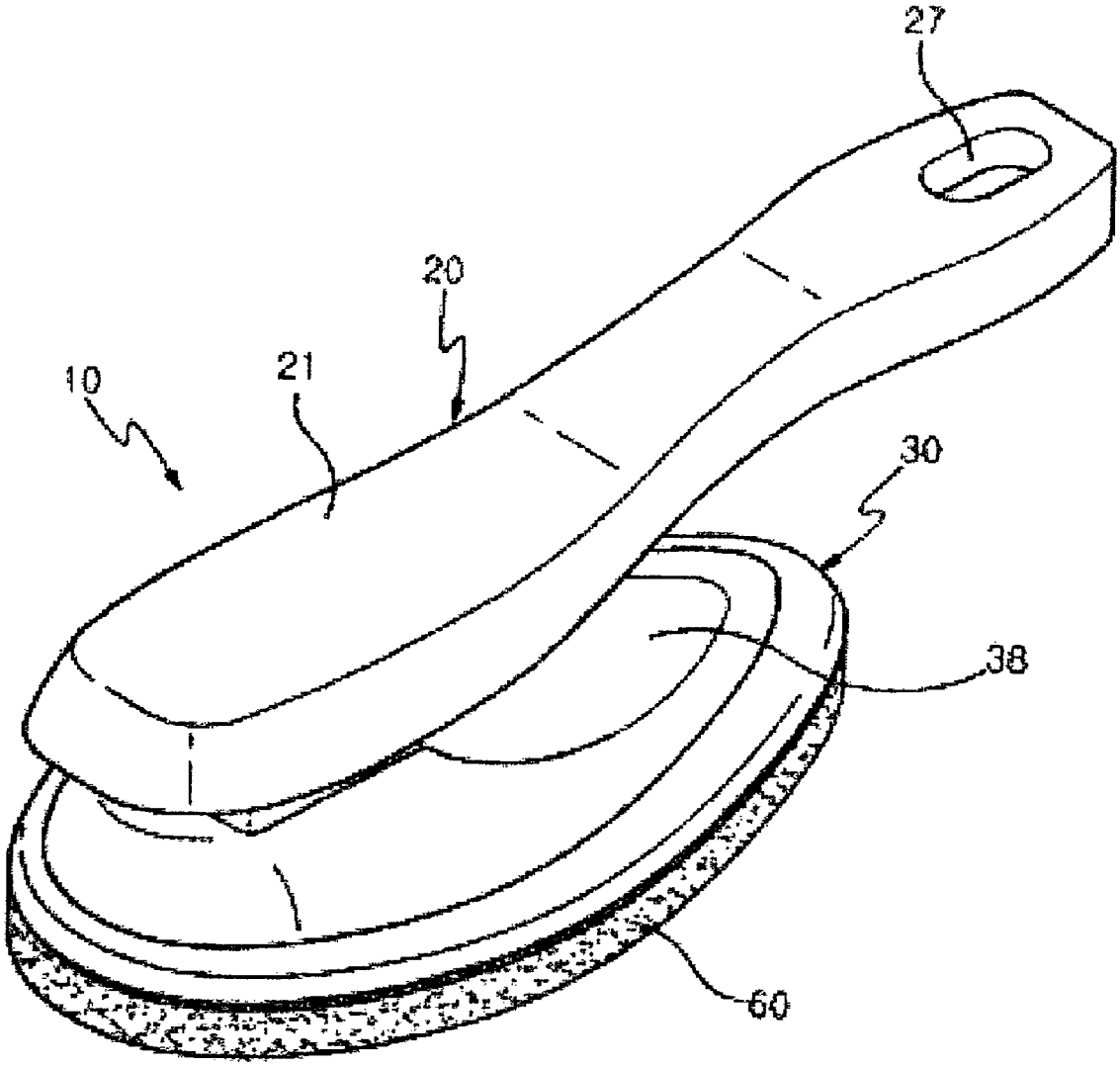
FIG. 1 is a perspective view illustrating a detachable multifunctional cleaner according to the present invention.
Figure 2:
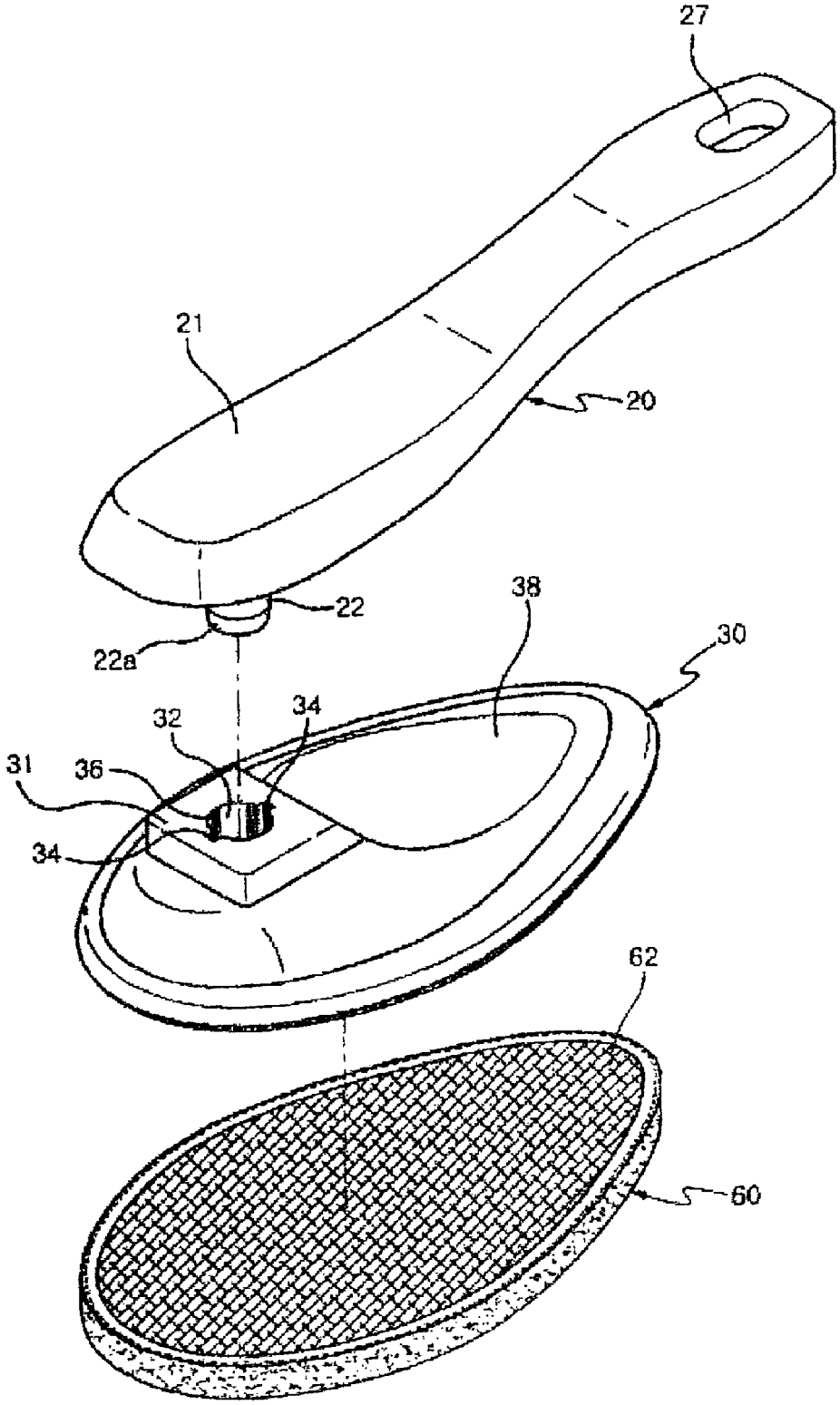
FIG. 2 is a disassembled perspective view of FIG. 1.
Figure 3:
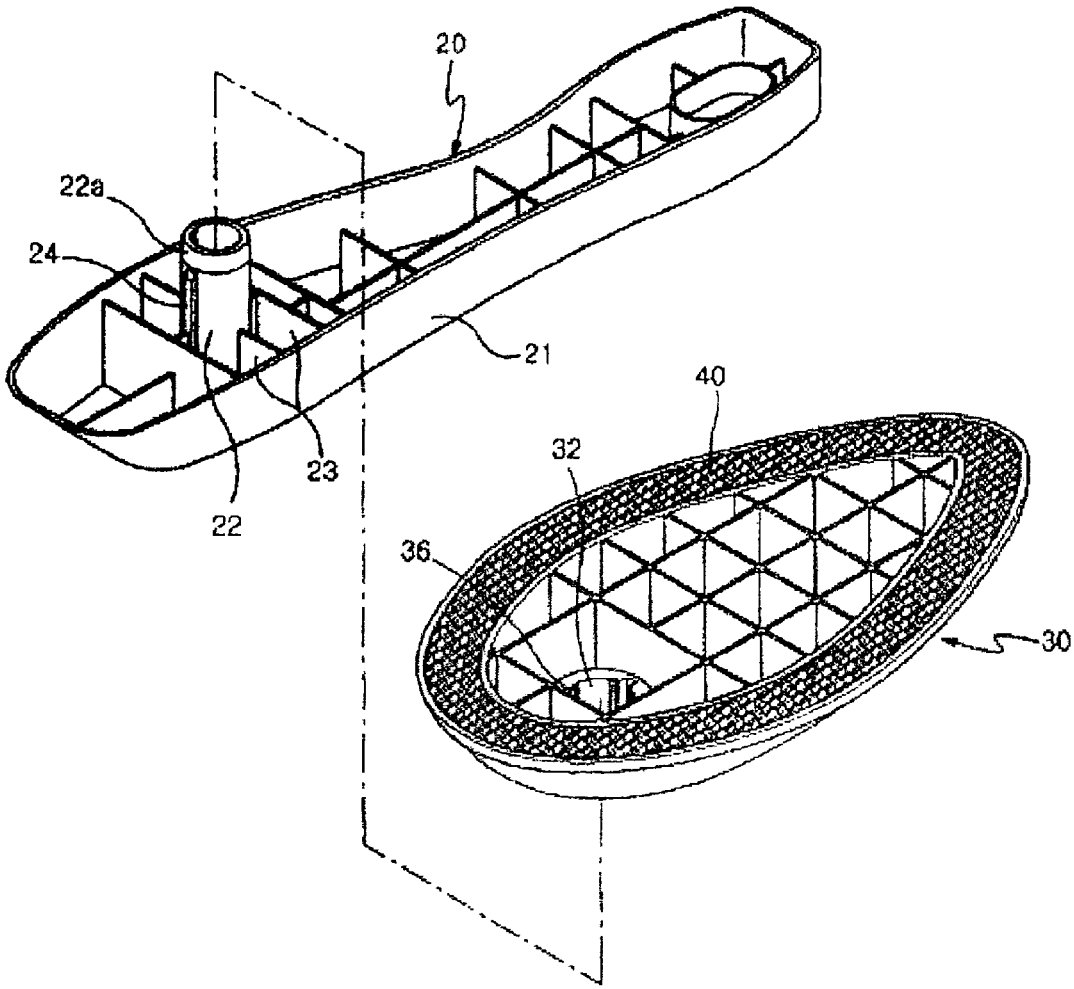
FIG. 3 is a perspective view illustrating a handle and a cover adapted to a detachable multifunctional cleaner according to the present invention.

The preferred embodiments of the present invention will be described with reference to the accompanying drawings.

As shown in FIGS. 1 through 4, the detachable multifunctional cleaner 10 according to the present invention comprises a handle 20, a cover 30 which is detachably engaged to the handle 20, and a foreign substance removing part which is detachable form the cover 30.

The handle 20 includes a handle body 21 preferably made of a synthetic resin, and an insertion piece 22 downwardly protruded from an end of the handle body 21.

The handle body 21 has a certain length and a thickness being larger enough to hold with hands. More preferably, the handle body 21 is equipped with a handle part 21 which is upwardly bent for an easier operation with one hand.

The insertion piece 22 is formed in a cylindrical shape having a tapered part 22*a* on an outer surface of the front end. The tapered part 22*a* allows the insertion piece 22 to be easily inserted into the cover 30, namely, into the insertion hole 32.

Figure 6A:
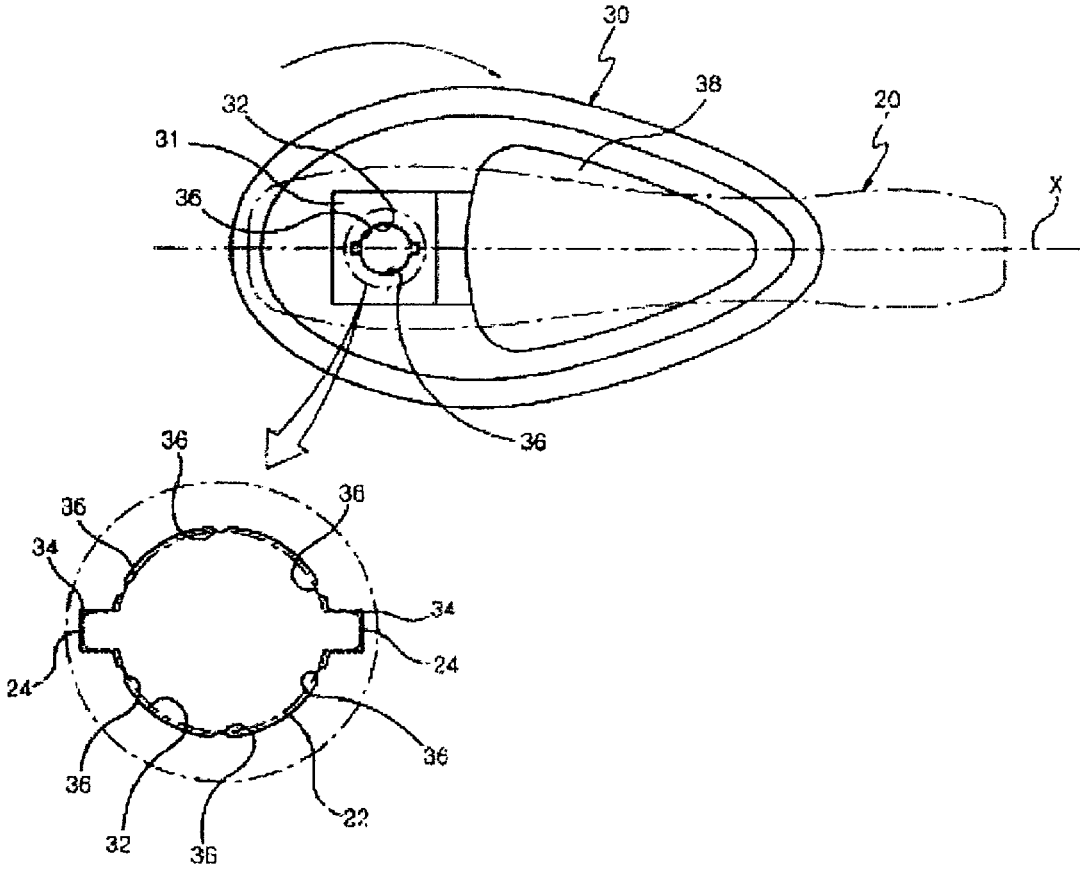
FIGS. 6A and 6B are plane views illustrating a detachable multifunctional cleaner connected with a handle by changing a direction of a cover according to the present invention.
Figure 6B:
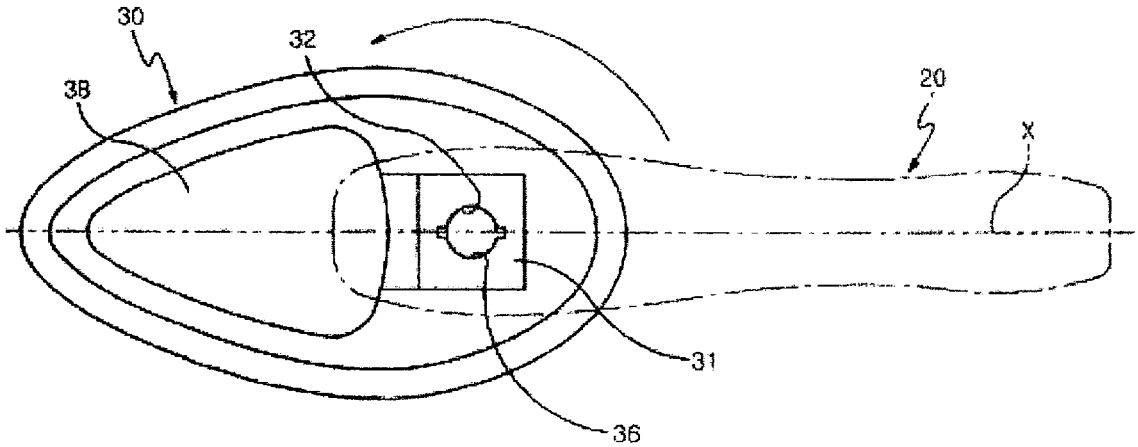

Two position determination protrusions 24 being apart from the tapered part 22*a* are formed in an outer surface of the insertion piece 22. Two position determination protrusions 24 are formed at 180° from each other. Namely, two position determination protrusions 24 are arranged on a central line X which passes through the longitudinal center portion of the handle body 21 as shown in FIG. 6A and FIG. 6B.

Here, a shoulder 24*a* is formed at an end of the position determination protrusion 24. When the assembling positions of the position determination protrusion 24 and the position determination groove 34 at the side of the cover 30 are not matched, the shoulder 24*a* is engaged with an engaging surface 31 of the cover 30 for thereby preventing an assembling at the mismatched position.

The cover 30 is made of a synthetic resin and includes an insertion hole 32 for inserting an insertion piece 22 when being engaged with the handle 20, and the insertion hole 32 is vertically formed in the engaging surface 31 protruded from one side of the upper surface of the cover 30, and the inner diameter of the insertion hole 32 is slightly larger than the outer diameter of the insertion piece 22.

Preferably, a plurality of engaging ribs 36 are formed in an inner surface of the insertion hole 32 while linearly contacting with the outer surface of the insertion piece 22. The engaging ribs 36 closely contact with the outer surface of the insertion piece 22 when the insertion piece 22 is inserted into the insertion hole 32 for thereby preventing the insertion piece 22 from being escaped from the insertion hole 32.

A concave part 38 is formed on the upper surface of the cover 30, so hands can be smoothly inserted between the handle 21 and the cover 30.

The insertion piece 22 and the insertion hole 32 are assembled on a vertical line Z which is perpendicular to the bottom surface of the cover 30.

Figure 4:
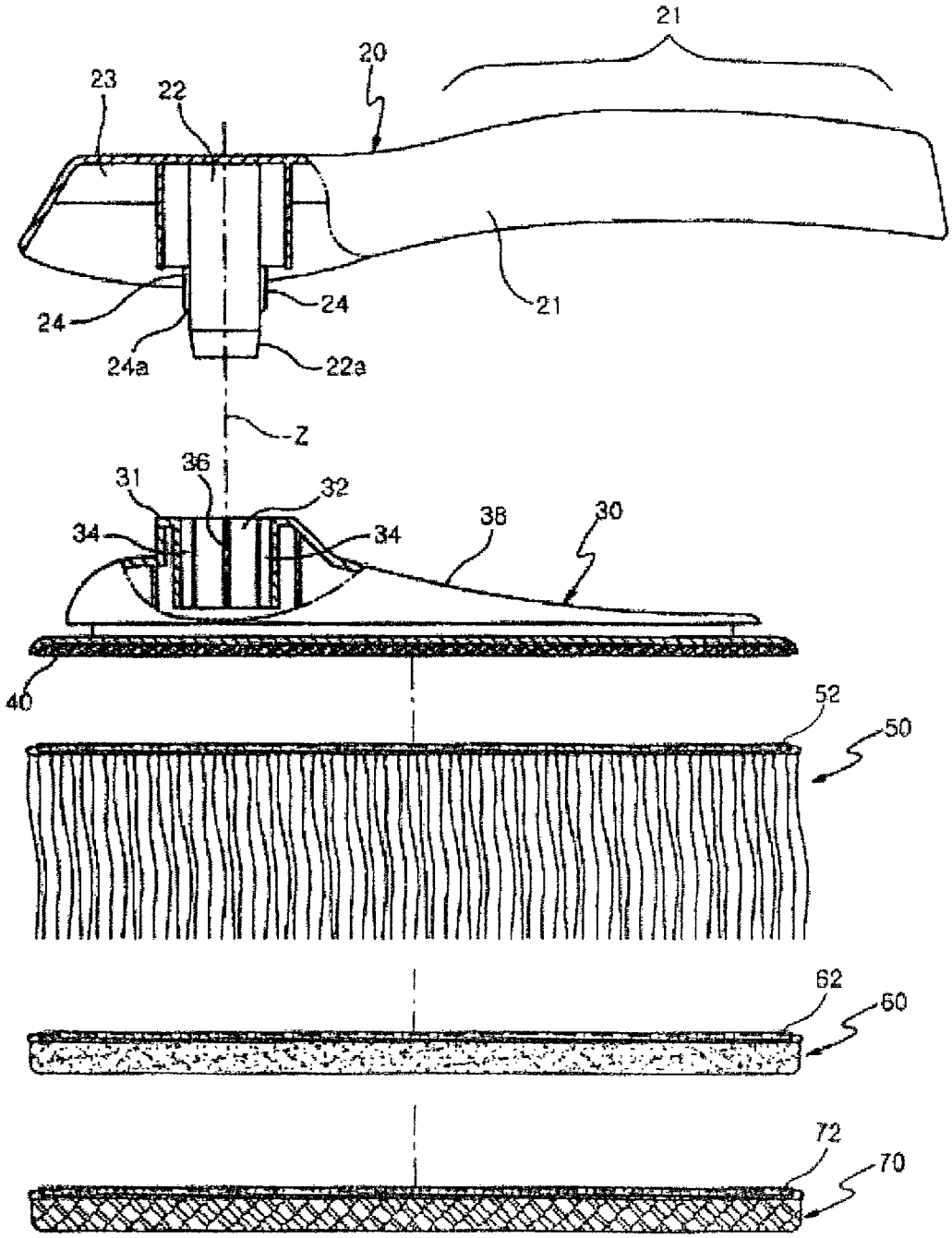
FIG. 4 is a front view before a handle, a cover and a foreign substance removing part adapted to a detachably multifunctional cleaner are assembled according to the present invention.

The foreign substance removing part is might be one among an oily cleaning cloth of FIG. 4, a sponge cleaning cloth 60 and a hairy cleaning cloth 70, which are detachably engaged to a Velcro fastener 40 of a bottom surface of the cover 30.

The oily cleaning cloth 50, the sponge cleaning cloth 60 and the hairy cleaning cloth 70 are equipped with the Velcro fasteners 52, 62 and 70 which are detachably attached to the Velcro fastener 40.

Here, the oily cleaning cloth 50 is made as a synthetic fiber or cotton fiber is soaked with oil (lubricant, additive and organic solvent) for thereby obtaining a polishing and dust removing function, and the sponge cleaning cloth 60 is made of a foamed sponge for removing the foreign substance during a water cleaning, and the hairy cleaning cloth 70 is formed of a hair, wool or micro fiber for removing water or polishing like wax.

In the present invention, the handle 20 and the cover 30 might be preferably made of synthetic resin materials, but might be made of other materials such as wooden, composite material, light non-steel metal or the like. In addition, the shapes and constructions of the handle 20 and the cover 30 are not limited to the shapes and constructions shown in the drawings.

Reference numerals 23 and 33 represent reinforcing ribs, and 27 represents a hanging hole.

The operation of the present invention will be described.

Figure 5A:
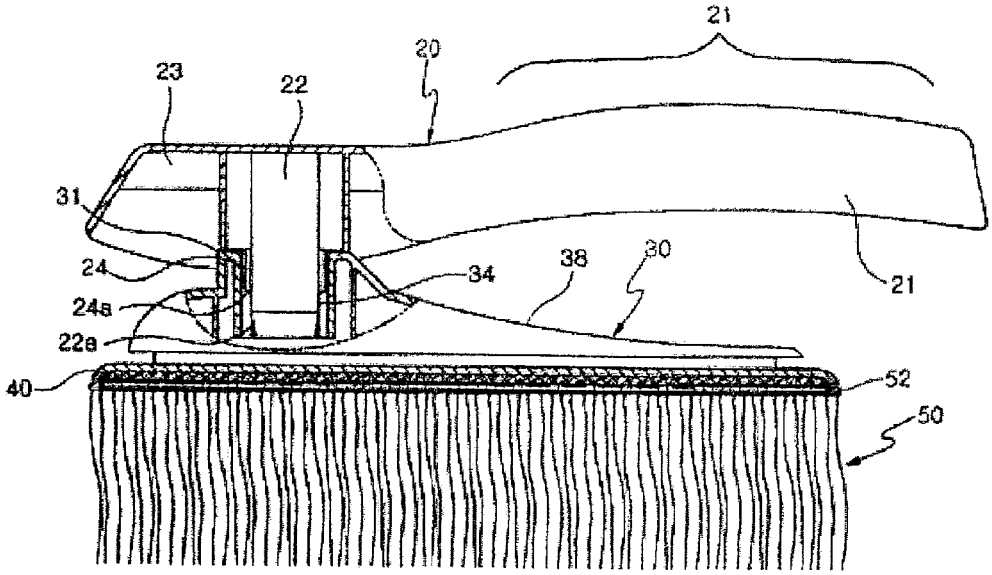
FIGS. 5A and 5B are partial cross sectional and front views illustrating a detachable multifunctional cleaner connected with a handle by changing a direction of a cover according to the present invention.
Figure 5B:
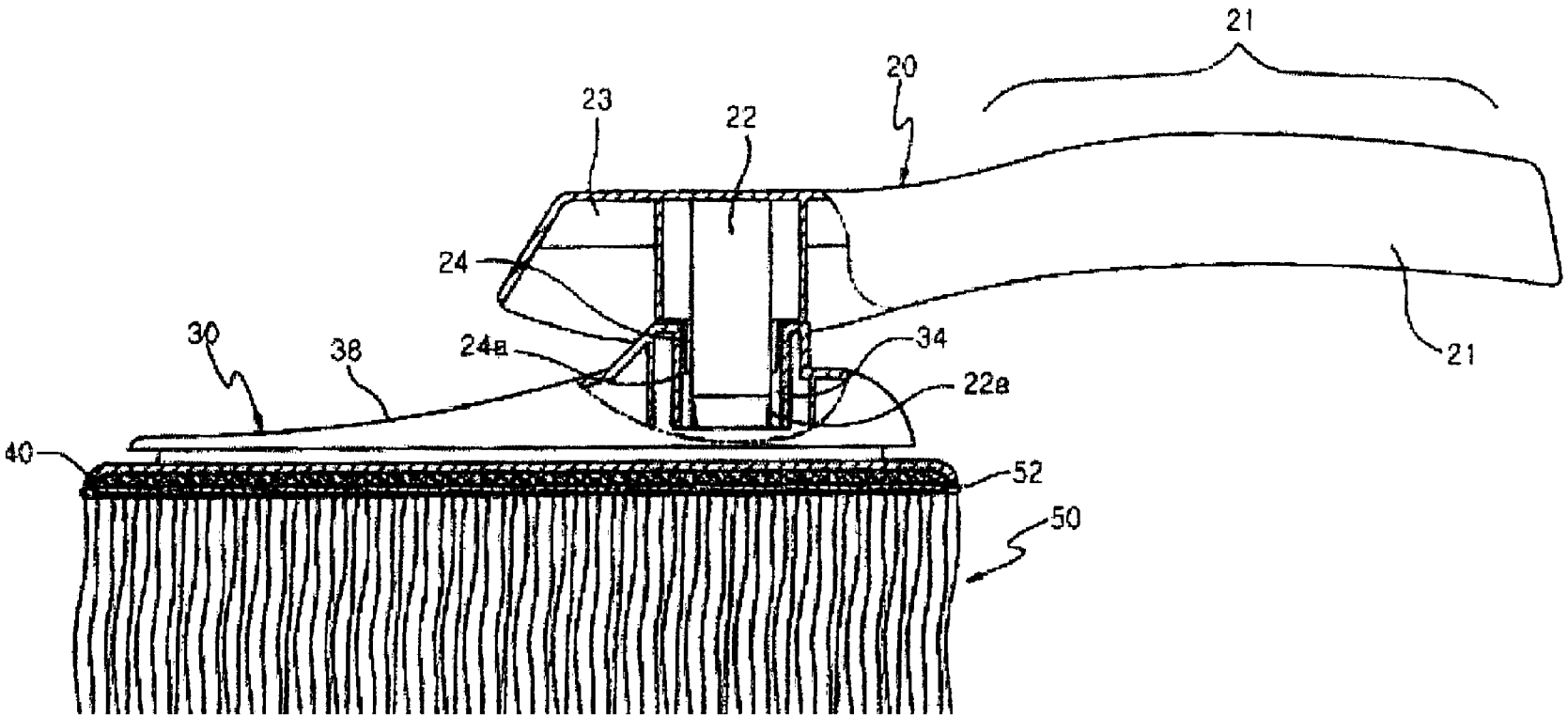

As shown in FIGS. 5B and 6B, the insertion piece 22 is inserted into the insertion hole 32, so that the cover 30 is protruded from the handle 20 and is made in a horizontally flat shape. At this time, the insertion piece 22 can be easily inserted into the insertion hole 32 with the help of the tapered part 22*a*.

When the assembling positions of the position determination protrusion 24 and the position determination groove 34 are not matched, the shoulder 24*a* of the position determination protrusion 24 is engaged by means of the engaging surface 31 of the cover 30. In this case, the position determination protrusion 24 can be easily matched with the position determination grove 34 by slightly rotating the handle 20.

In this state, as the insertion piece 22 is pushed and inserted into the insertion hole 32. When it is inserted, the engaging ribs 36 are linearly and closely contacted with the outer surface of the insertion piece 22.

One among the oily cleaning cloth 50, the sponge cleaning cloth 60 and the hairy cleaning cloth 70 is attached to the bottom surface of the cover 30, and the surface of the vehicle or the window glass can be cleaned.

When the cover 30 is rotated at 180° and is used depending on a user's selection, the cover 30 is separated from the handle 20. At this time, the insertion piece 22 is pulled out from the insertion hole 32 while holding the cover 30 with the hand which does not hold the handle 20.

Next, in a state that either the handle 20 or the cover 30 is rotated at 180°, the insertion piece 22 is reinserted into the insertion hole 32. At this time, the engaging positions between the position determination protrusion 24 and the position determination groove 34 are opposite from each other as shown in FIGS. 5A and 5B.

The cover 30 positions inside the handle body 21, so the entire length can be shorter. Namely, the detachable multifunctional cleaner 10 is formed in a channel shape with the entire length being shorter.

In this state, when the detachably multifunctional cleaner 10 can be used for more reliably and effectively removing pollutants or polishing while pressurizing the cover 30 with more intensive force. In addition, since the detachable multifunctional cleaner 10 is shorter when storing the same and is compact, the storing space can be significantly decreased.

In the detachable multifunctional cleaner 10 according to the present invention, the handle 20 and the cover 30 can be easily engaged and separated by means of the insertion engaging method, so the number of parts can significantly decrease, and the manufacture does not cost a lot.

As the cover 30 is rotated at 180° and is engaged, it is possible to clean with more intensive force.

Since the oily cleaning cloth 50, the sponge cleaning cloth 60 and the hairy cleaning cloth 70 can be selectively and detachably engaged to the cover 30, so a dust removing work, oil cleaning, water washing and polishing work can be all conducted.

In the present invention, the insertion piece 22 and the insertion hole 32 are assembled to the bottom surface of the cover 30 on a vertical line, so the engaging force is not loosened during the use of the cleaner. The loosening and tightening work are not needed in the present invention as compared to the conventional art, and the loosening problems do not occur in the present invention.

In the embodiment of the present invention, two position determination protrusions 24 and two position determination grooves 34 are provided, respectively, but in the present invention they can be provided in either the handle 20 or the cover 30.

The multifunctional cleaner 10 of the present invention might be used for removing dusts and pollutants from a vehicle, a window glass, furniture or sofa or for washing or polishing the same.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A detachable multifunctional cleaner, comprising:

a handle which has an insertion piece downwardly protruded from one end;

a cover which has an insertion hole at one side of an upper surface for inserting the insertion piece; and a foreign substance removing means which is detachably attached to the cover, wherein said foreign substance removing means is one among an oily cleaning cloth, a sponge cleaning cloth, and a hairy cleaning cloth which are detachably attached to a hook-and-loop fastener attached to a bottom surface of the cover, wherein the insertion piece and the insertion hole are assembled on a vertical line (Z) with respect to a bottom surface of the cover, and at least one position determination protrusion and at least one position determination groove are formed in the insertion piece and the insertion hole, respectively, for determining the engaging rotational position of the handle about the vertical line (Z).

2. The cleaner of claim 1, wherein said insertion piece is formed in a cylindrical shape having a tapered part on an outer surface of the front end.

3. The cleaner of claim 2, wherein two position determination protrusions being apart from the tapered part are formed on the outer surface of the insertion piece at 180.degree. from each other.

4. The cleaner of one among claim 1, wherein a plurality of engaging ribs are formed in an inner surface of the insertion hole while linearly contacting with the outer surface of the insertion piece.

5. The cleaner of claim 1, wherein a concave part is formed on an upper surface of the cover, so hands can be easily inserted between the handle and the cover.

* * * * *